US006421955B1

(12) United States Patent
Wilson

(10) Patent No.: US 6,421,955 B1
(45) Date of Patent: Jul. 23, 2002

(54) FLORAL ROCK ARRANGEMENT

(76) Inventor: Ellen A. Wilson, 2912 Elmridge Dr., Flower Mound, TX (US) 75022

( * ) Notice: Subject to any disclaimer, the term of this patent is extended or adjusted under 35 U.S.C. 154(b) by 0 days.

(21) Appl. No.: 09/618,348

(22) Filed: Jul. 18, 2000

(51) Int. Cl.[7] ..... A47G 7/02
(52) U.S. Cl. ..... 47/41.12; 47/65.7
(58) Field of Search ..... 47/65.5, 65.7, 47/41.01, 41.1, 41.12, 87

(56) References Cited

U.S. PATENT DOCUMENTS

| | | | | | |
|---|---|---|---|---|---|
| 858,939 | A | | 7/1907 | Angeloro | |
| 1,589,848 | A | | 6/1926 | Harrison | |
| 1,762,082 | A | * | 6/1930 | Shiraishi | |
| 2,904,932 | A | | 9/1959 | Seewan | 47/41 |
| 3,158,524 | A | | 11/1964 | Tong | 161/27 |
| 3,169,897 | A | | 2/1965 | Yue | 161/31 |
| 3,261,126 | A | * | 7/1966 | Marks | |
| 4,600,612 | A | * | 7/1986 | Litwin et al. | 428/23 |
| 5,856,024 | A | * | 1/1999 | Parr | 428/542.2 |
| 6,219,967 | B1 | * | 4/2001 | Powell | 47/65.5 |

OTHER PUBLICATIONS

Anonymous, Examiner's Document A, found at www.sw-coloradowildflowers.com, data of photo Aug. 1, 2000.*

Anonymous, Examiner's Document B, found at members.cruzio.com/~bluejay/sierramenu.html, undated.*

Anonymous. at least 1997. Natural Stone Garden Planters. featherrock, Chatsworth, CA.*

* cited by examiner

*Primary Examiner*—Peter M. Poon
*Assistant Examiner*—Jeffrey L. Gellner
(74) *Attorney, Agent, or Firm*—Michael Diaz

(57) ABSTRACT

A rock arrangement having a plurality of foliage. The arrangement includes a rock and a plurality of foliage. The foliage may include flowers, plants, and feathers. Each of the plurality of foliage includes a stem. A rigid polystyrene material is formed and affixed to a portion of the rock. In addition, a segment of moss material is affixed to a top portion of the rigid polystyrene material. Each stem of the foliage is embedded into the polystyrene material. The moss is used to conceal the polystyrene material, thereby providing an appearance of the plurality of foliage growing from the rock.

11 Claims, 2 Drawing Sheets

FLORAL ROCK ARRANGEMENT

BACKGROUND OF THE INVENTION

1. Technical Field of the Invention

This invention relates to a rock arrangement, and more particularly, to a rock arrangement having a plurality of foliage attached to the arrangement.

2. Description of Related Art

There are a variety of furnishings used to decorate a home or office. Some furnishings are flower arrangements, while other furnishings include sculptures, pictures, and furniture. Home furnishings can provide a specific ambience for a room as desired by the occupant. However, creating unique natural settings as home furnishings are difficult to achieve. It would be beneficial to have a furnishing which incorporates a rock having various types of foliage appearing to grow from the rock.

Although there are no known prior art teachings of an arrangement or method such as that disclosed herein, prior art references that discuss subject matter that bears some relation to matters discussed herein are U.S. Pat. No. 858,939 to Angeloro (Angeloro), U.S. Pat. No. 1,589,848 to Harrison (Harrison), U.S. Pat. No. 1,762,082 to Shiraishi (Shiraishi), U.S. Pat. No. 3,158,524 to Tong (Tong), and U.S. Pat. No. 3,169,897 to Yue (Yue).

Angeloro discloses a stone structure in the form of a vase. The vase includes a facing of natural or cobble stones. A hollow column is used as a central support for the vase. The column includes a series of leaves produced by longitudinally slitting the column. Horizontal wires are strung along the leaves. In addition, vertical wires are crossed over the horizontal wires, producing mesh openings. The stones are positioned and affixed with cement within the mesh openings. However, Angeloro does not teach or suggest embedding a plurality of foliage within a material affixed to the surface of a rock. In addition, Angeloro does not disclose a rock which gives the appearance of foliage naturally growing from the rock.

Harrison discloses a process for mounting artificial flowers within a base. The base is constructed from a plastic material constructed of a plastic or mineral wax having a tough pliable texture. The material of the base must be susceptible to being melted when contacted by a flame. The base is partially melted and stems of the flowers are then embedded into the softened base. In addition, moss or gravel may be affixed around the stems of the flowers to give the flower and shrubbery the appearance of natural growth. However, Harrison does not teach or suggest a natural rock as the base. Harrison requires utilizing a base which can be melted to allow the flowers to be embedded into the base. Additionally, Harrison does not disclose utilizing a polystyrene material or floral clay to affix the flowers to the base. Harrison also suffers from the disadvantage of requiring the use of a meltable material, which does not give the appearance of a natural rock having flowers growing from the rock. The base disclosed in Harrison is also not as durable as a rock, since the material of the base is susceptible to heat.

Shiraishi discloses a vase having irregular shapes and sizes of lava cemented to the vase. The lava is affixed to the vase in such a manner as to give the appearance that the lava has been formed onto the vase. The vase is constructed from glass and reinforced with wire. The vase is coated with cement and used to secure the lava to the vase. However, Shiraishi does not teach or suggest a rock having a plurality of foliage affixed to the rock to provide an appearance of the foliage growing from the rock.

Tong discloses a floral display having a base for an artificial floral display which can be disassembled for shipping. The base has a plurality of holes and a corresponding number of artificial flower stems arranged on the base. The stems are attached to the base by keying the stem to the base. The keying means includes holes located on the base which accept the lower ends of the stems. Tong does not teach or suggest affixing foliage to a rock to give the appearance that the foliage is growing out of the rock. Tong merely discloses a plurality of holes for accepting the stems of artificial flowers.

Yue discloses a base plate for an artificial flower arrangement. The base plate includes a support sheet having a plurality of openings. Within each opening is an adapter to permit the stem of a flower to be inserted and supported. However, Yue does not teach or suggest affixing a plurality of foliage to a rock by embedding the stems of the foliage into a polystyrene material or floral clay.

Review of each of the foregoing references reveals no disclosure or suggestion of a floral rock arrangement or a method of constructing the arrangement as that described and claimed herein. Thus, it would be a distinct advantage to have an arrangement which gives the appearance of foliage growing from the rock arrangement. It is an object of the present invention to provide such an arrangement and method of constructing the arrangement.

SUMMARY OF THE INVENTION

In one aspect, the present invention is a floral rock arrangement. The arrangement includes a rigid base support structure and a plurality of foliage. Each of the plurality of foliage has a stem. Additionally, the arrangement includes a supporting material affixed and formed to a portion of the base support structure. Each stem of the foliage is embedded into the rigid material, thereby providing an appearance of the plurality of foliage growing from the rigid base support structure.

In another aspect, the present invention is a floral rock arrangement. The arrangement includes a rock and a plurality of foliage. Each of the foliage has a stem. The arrangement also includes a rigid polystyrene material affixed and conformed to a portion of the rock and a segment of moss material affixed to a top portion of the rigid polystyrene material. Each stem of the plurality of foliage is embedded into the polystyrene material while the segment of moss conceals the polystyrene material, which provides an appearance of the plurality of foliage growing from the rock.

In still another aspect, the present invention is a method of constructing a floral rock arrangement having a rock, a polystyrene material, and a plurality of foliage having stems. The method begins with selecting a rock for use as a base support structure. Next, a plurality of foliage for use in the floral rock arrangement are selected. The polystyrene material is then shaped. Next, the polystyrene material is affixed to the rock. The stems are then embedded into the polystyrene material.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

A rock arrangement having a plurality of foliage and a method of constructing the arrangement is disclosed.

Figure 2:
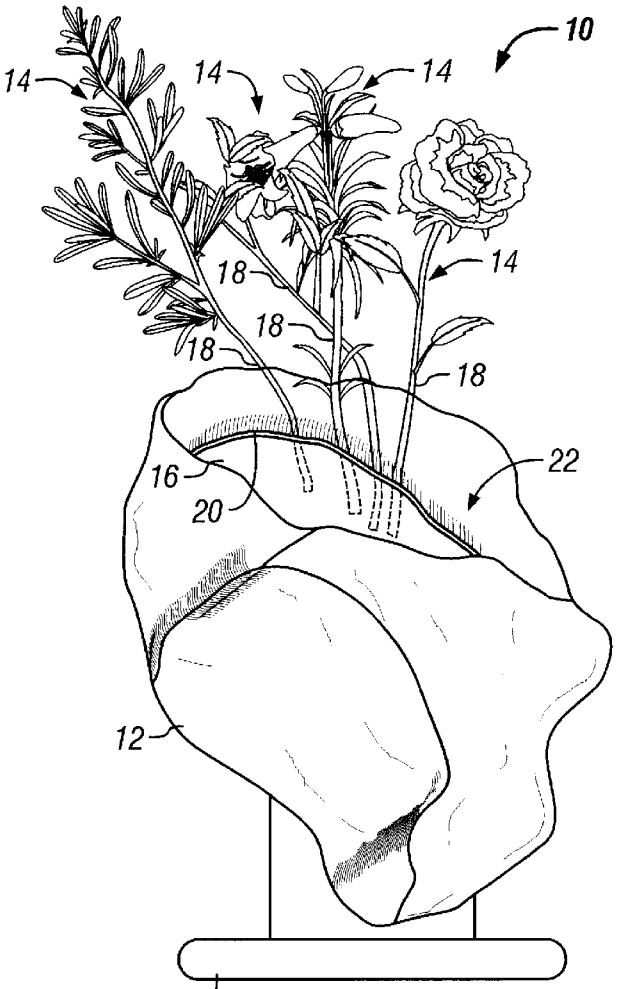
FIG. 2 is a side perspective view of the rock floral arrangement of FIG. 1.
Figure 1:
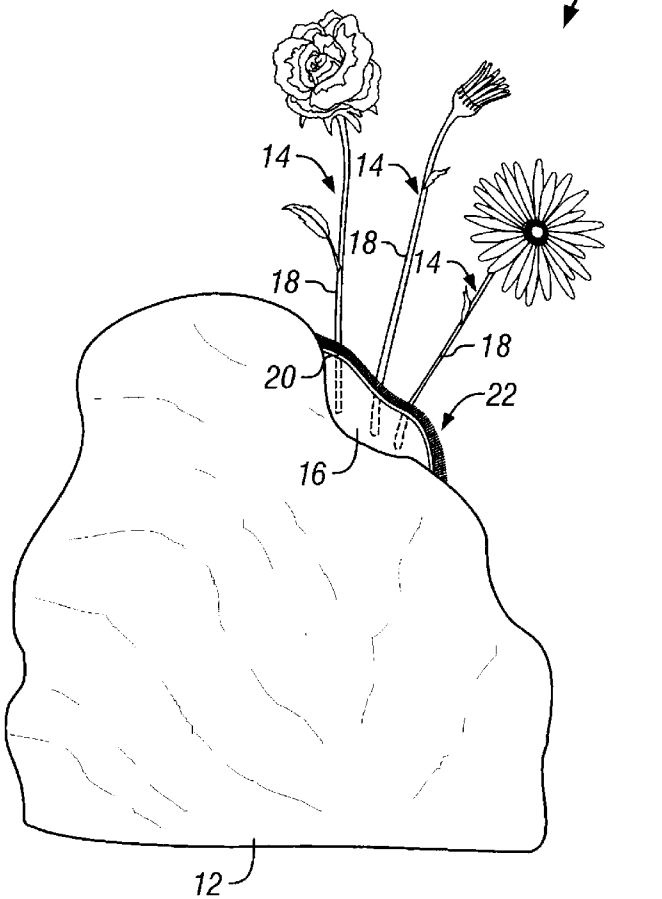
FIG. 1 is a side elevational view of a rock floral arrangement.

FIG. 1 is a side elevational view of a rock floral arrangement 10. FIG. 2 is a side perspective view of the rock floral arrangement 10 of FIG. 1. The arrangement includes a rock 12, a plurality of foliage 14, and a portion of polystyrene material 16 affixed to the rock. The plurality of foliage may include any type of plant, bark, flower, feather or any material providing an appearance thereof. The rock is preferably a semiprecious stone.

The polystyrene material may be shaped in any fashion providing a natural contour to the rock. Typically, the polystyrene material is cut to a specific dimension to accommodate an indentation located on the rock.

The polystyrene material is permanently affixed to the rock. Preferably, the polystyrene material is affixed to the rock by hot glue, however any material having adhesive qualities may be utilized. In alternate embodiments of the present invention, other supporting materials other than polystyrene material may be used, which allows the penetration of stems, yet still supports the embedded stems, such as floral clay or wax.

The plurality of foliage are preferably flowers, bark-like materials (e.g., branches), and plants constructed of silk or any other resilient synthetic material. The plurality of foliage may include flower, bark substances, plant, or flowers, each having a stem 18. The stem provides a long appendage which is embedded into the polystyrene material 16. The stem is embedded into the polystyrene material by pressing the stem directly through the polystyrene material. The polystyrene material allows the penetration of the stem into a depth of the polystyrene material while still supporting the embedded stems.

Once the stems are embedded into the polystyrene material, floral clay 20 is optionally used to further secure the stems within the polystyrene material. Preferably, hot glue is also used to secure the stems in place. Additionally, to hide the polystyrene material and floral clay from view by an observer, a segment of moss 22 is affixed to a top portion of the exposed areas of the polystyrene material and floral clay. In alternate embodiments, other types of concealing material may be used to conceal the polystyrene material. However, it is preferred that the concealing material be some type of greenery, thus providing a natural setting for the rock and plurality of foliage.

In an alternate embodiment of the present invention, the stems are affixed directly to the rock. In this alternate embodiment, the stems 18 are affixed by a material having adhesive qualities, such as hot clue or clay in this alternate embodiment.

The rock floral arrangement, when assembled, provides the appearance of the plurality of foliage 14 growing directly from the rock. The rock may then be displayed on a stand 26. Polystyrene material is preferably used because polystyrene material may be shaped to provide a natural appearing portion of the rock 12, while still maintaining its shape when embedding the stems 18 into material affixed to the rock. By affixing the moss to the upper portion of the polystyrene material, the moss conceals the polystyrene material from view by an observer.

Figure 3:
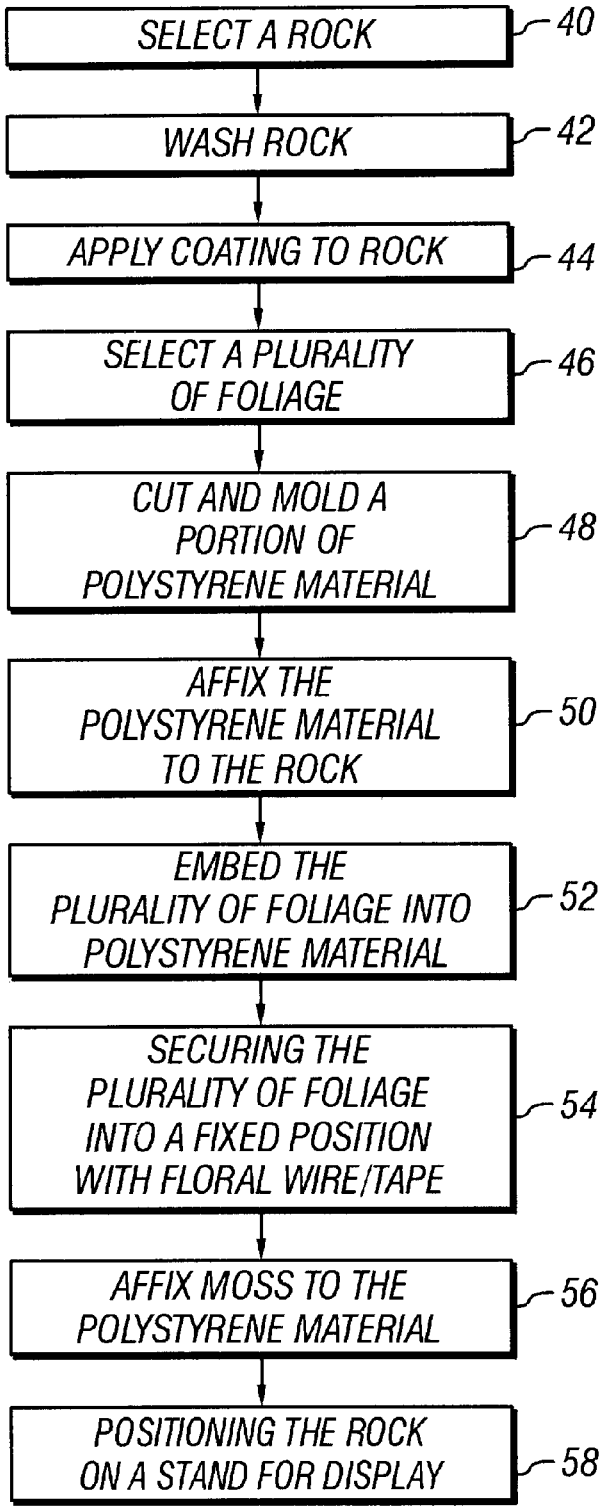
FIG. 3 is flow chart illustrating the steps of constructing the rock floral arrangement in accordance with the teachings of the present invention.

FIG. 3 is flow chart illustrating the steps of constructing the rock floral arrangement 10 in accordance with the teachings of the present invention. With reference to FIGS. 1, 2, and 3, the method of constructing the rock floral arrangement 10 will now be explained. In step 40, a rock 12 is selected. The rock provides the base structure to which the plurality of foliage 14 is to be affixed. In many arrangements, the rock is a semiprecious stone. Next, in step 42, the rock is washed to remove residues from the exterior of the rock. The method moves to step 44, where a polyurethane coating may be optionally applied to the rock. The coating may be added to the rock if the rock is composed of a material which leaves a residue material. The coating may be any material which can be applied to the rock, yet dries in place on the rock. By applying the coating, the residue is prevented from falling off the rock. Next, in step 46, the plurality of foliage 14 is selected. The plurality of foliage may include plants, flowers, bark substances (e.g., branches) and/or feathers selected to complement the rock's shape, color, and size. The method then moves to step 48 where the polystyrene material 16 is cut and molded to the contours of a portion of the rock. Typically, the polystyrene material is positioned within an indentation located on the rock. In step 50, the polystyrene. material is then affixed to the rock by a material having adhesive properties, such as hot glue and floral clay 20. Next, in step 52, the stems 18 of the plurality of foliage are embedded into the polystyrene material and secured with hot glue on the areas surrounding the stem and polystyrene material. In an alternate embodiment of the present invention, the stems are affixed directly to the rock by an adhesive material, such as hot glue or floral clay. In step 54, the stems may be additionally secured by the use of floral wire, floral clay, and/or floral tape which is commonly used in floral arrangements to secure flowers in a desired position. The floral wire and tape are affixed to the plurality of foliage to set the foliage in a desired position. In alternate embodiments, floral clay may be positioned along the stems. The stems can then be positioned to adjacent stems in various desired positions. Next, in step 56, a concealing material such as moss 22 may also be applied to the polystyrene material by affixing the moss to the polystyrene material by utilizing an adhesive, such as hot glue. In step 58, the rock may optionally be placed in the stand 26 allowing the arrangement to be displayed.

The floral rock arrangement provides many advantages over ordinary floral arrangements. First, the arrangements provide a very unique visual illusion of plants growing out of the rock centerpiece. Additionally, the visual display is colorful and provides a natural setting to a room. In addition, the arrangement remains solidly affixed to the rock, providing a long-lasting and permanent home furnishing item to any room. The arrangement is also far more durable and resistant to heat than existing arrangements.

It is thus believed that the operation and construction of the present invention will be apparent from the foregoing description. While the arrangement and method shown and described has been characterized as being preferred, it will be readily apparent that various changes and modifications could be made therein without departing from the scope of the invention as defined in the following claims.

What is claimed is:

1. A floral rock arrangement, the arrangement comprising:

a rock having a surface;

a plurality of foliage, each of said foliage having a stem; and a supporting material conformed and affixed to a portion of the base support structure without altering the surface of the rock, wherein the supporting material is constructed of a polystyrene material;

whereby each stem of the plurality of foliage is embedded into the supporting material, thereby providing an appearance of the plurality of foliage growing from the rock.

2. A floral rock arrangement, the arrangement comprising:

a rock having a surface;

a plurality of foliage, each of said foliage having a stem; and a supporting material conformed and affixed to a portion of the base support structure without altering the surface of the rock, wherein the supporting material is affixed to the rock by an adhesive material;

whereby each stem of the plurality of foliage is embedded into the supporting material, thereby providing an appearance of the plurality of foliage growing from the rock.

3. The floral rock arrangement of claim 2 wherein the adhesive material is glue.

4. A floral rock arrangement, the arrangement comprising:

a rock having a surface;

a plurality of foliage, each of said foliage having a stem;

a supporting material conformed and affixed to a portion of the base support structure without altering the surface of the rock; and floral tape affixed to the plurality of foliage, said floral tape setting the plurality of foliage in a desired position;

whereby each stem of the plurality of foliage is embedded into the supporting material, thereby providing an appearance of the plurality of foliage growing from the rock.

5. A floral rock arrangement, the arrangement comprising:

a rock having a surface;

a plurality of foliage, each of said foliage having a stem;

a rigid polystyrene material conformed and affixed to a portion of the rock; and a segment of moss material affixed to a top portion of the rigid polystyrene material;

whereby each stem of the plurality of foliage is embedded into the polystyrene material without altering the surface of the rock and the segment of moss conceals the polystyrene material, thereby providing an appearance of the plurality of foliage growing from the rock.

6. A method of constructing a floral rock arrangement, said arrangement having a rock, a polystyrene material, and a plurality of foliage having stems, the method comprising the steps of:

selecting a rock for use as a base support structure;

selecting a plurality of foliage for use in the floral rock arrangement;

shaping a portion of polystyrene material;

affixing the portion of polystyrene material to the rock without altering the surface of the rock; and embedding the stems of the plurality of foliage into the polystyrene material.

7. The method of constructing a floral rock arrangement of claim 6 further comprising, after the step of embedding the stems of the plurality of foliage, the step of affixing a segment of moss material to a top portion of the polystyrene material.

8. The method of constructing a floral rock arrangement of claim 6 wherein the step of affixing the portion of polystyrene material to the rock includes:

applying hot glue to the polystyrene; and positioning the polystyrene material to the rock.

9. The method of constructing a floral rock arrangement of claim 6 further comprising, after the step of embedding the stems of the plurality of foliage into the polystyrene material, the step of securing the plurality of foliage into a fixed position with floral wire.

10. The method of constructing a floral rock arrangement of claim 6 further comprising, after the step of embedding the stems of the plurality of foliage into the polystyrene material, the step of securing the plurality of foliage into a fixed position with floral tape.

11. The method of constructing a floral rock arrangement of claim 6 further comprising, after the step of embedding the stems of the plurality of foliage into the polystyrene material, the step of positioning the rock on a stand for display of the floral rock arrangement.

* * * * *